US006385328B1

(12) United States Patent
Yoo et al.

(10) Patent No.: US 6,385,328 B1
(45) Date of Patent: May 7, 2002

(54) ELECTRO-ACOUSTIC MICRO-TRANSDUCER HAVING THREE-MODE REPRODUCTION FEATURE

(75) Inventors: Dong Ok Yoo, Kyungki-do; Kyung Ho Kim, Seoul, both of (KR)

(73) Assignee: Microtech Corporation, Kyungki-do (KR)

( * ) Notice: Subject to any disclaimer, the term of this patent is extended or adjusted under 35 U.S.C. 154(b) by 0 days.

(21) Appl. No.: 09/576,607

(22) Filed: May 24, 2000

(30) Foreign Application Priority Data

Aug. 23, 1999 (KR) ..... 99-34975

(51) Int. Cl.[7] ..... H04R 25/00
(52) U.S. Cl. ..... 381/412; 381/420; 381/409
(58) Field of Search ..... 381/412, 419, 381/420, 409, 410, 411, FOR 159

(56) References Cited

U.S. PATENT DOCUMENTS

| | | | | |
|---|---|---|---|---|
| 4,376,233 A | * | 3/1983 | Kamon et al. | |
| 5,883,967 A | * | 3/1999 | House | |
| 6,035,052 A | * | 3/2000 | Fujihira et al. | |
| 6,175,637 B1 | * | 1/2001 | Fujihira et al. | |
| 6,208,743 B1 | * | 3/2001 | Marten | |

FOREIGN PATENT DOCUMENTS

| | | | | |
|---|---|---|---|---|
| DE | 2503828 | * | 8/1976 | ..... 381/FOR 159 |
| JP | 62-289099 | * | 12/1987 | ..... 381/FOR 159 |
| JP | 3-80799 | * | 4/1991 | ..... 381/FOR 159 |
| JP | 19586 | * | 8/1993 | ..... 381/FOR 159 |
| JP | 6-269089 | * | 9/1994 | ..... 381/FOR 159 |
| JP | 2001-54192 | * | 2/2001 | |
| SU | 1570-036 | * | 6/1990 | ..... 381/FOR 159 |

* cited by examiner

*Primary Examiner*—Sinh Tran
(74) *Attorney, Agent, or Firm*—Rosenberg, Klein & Lee

(57) ABSTRACT

An electro-acoustic micro-transducer having a high power, high efficiency acoustic transducing feature and a three-mode broad band frequency reproduction feature on a micro-scale basis is provided. The electro-acoustic micro-transducer includes a yoke formed of an internal groove and a vertical incision portion for removing a vertical wall at one side surface, a permanent magnet installed in the groove of the yoke, a plate for forming a magnetic gap, a coil wound on the bobbin, a frame which surrounds the yoke, in which a throughhole is formed in the groove corresponding to the incision portion of the yoke, and a vibration diaphragm. Therefor, spaces in the incision portion of the yoke and the frame are formed so that a connection portion between the coil and lead wire can be prevented from contacting the yoke during vertical vibration, to thereby extend an up-and-down vibration width of the bobbin.

10 Claims, 14 Drawing Sheets

ELECTRO-ACOUSTIC MICRO-TRANSDUCER HAVING THREE-MODE REPRODUCTION FEATURE

TECHNICAL FIELD

The present invention relates to an electro-acoustic micro-transducer having a three-mode reproduction feature, and more particularly to an electro-acoustic micro-transducer having a high power, high efficiency acoustic transducing feature and a three-mode broad band frequency reproduction feature on a micro-scale basis in a compact electronic appliance, in which part of a yoke is cut out and simultaneously a soft material is used as edges of the incised yoke so that a moving coil assembly can be sufficiently vibrated up and down.

BACKGROUND ART

In general, an acoustic reproduction apparatus is classified into a horn type speaker, a system speaker which is used for a hifi audio system such as a component system, including a woofer, mid-ranger and tweeter covering a respectively particular frequency band, a general speaker covering all frequency bands via a single unit, a micro-speaker having an ultra-light and ultra-slim structure which is used in a compact electronic appliance such as a ultra-compact camcorder and walkman, a receiver used for a mobile communications terminal, an earphone having a structure whose part is inserted into the ear, and a buzzer for reproducing only a frequency of a particular band.

In a conventional general speaker, a bobbin around which voice coils are wound is positioned in a magnetic circuit in which a single magnet is installed in a yoke and a top plate is installed on top of the magnet. Also, the upper portion of the bobbin has a structure where the outer circumferential portion thereof is fixed to the upper and lower portion of a frame, the center portion thereof is fixed to a circularly perforated vibration plate and damper, and a center cap called a dust cap for closing the whole of the bobbin is combined in the center portion of the vibration plate.

However, a micro-speaker used in a mobile phone, a camcorder, a notebook PC, an ultra-compact cassette recorder, adopts an electro-dynamic type structure in which a damper is omitted and simultaneously the height of a frame portion is lowered so as to accomplish an ultra-compact and ultra-thin type structure in correspondence to compactness of a set.

In the electro-dynamic speaker as shown in FIG. 1*a,* a protector 1 is covered on the upper end of a groove type frame 2, a terminal plate 9 is fixed to one side on the bottom surface of the frame 2, and a magnetic circuit is formed of a yoke 8 fixed in the center portion of the frame bottom, a permanent magnet 6 and a plate which are coupled in the yoke 8. A moving coil 5 fixed to a vibration plate 3 is fixed to an edge 4 of the vibration plate 3 formed in the intermediate step portion of the frame 2, so as to be moved in a magnetic gap G between the yoke 8 and the plate 7. In FIG. 1*a,* a reference numeral 10 denotes an air ventilation hole and a reference numeral 11 denotes a signal lead wire.

The electro-dynamic micro-speaker has a structure for generating an acoustic sound in correspondence to a driving signal created by the up-and-down vibration of the vibration plate 3 and the moving coil 5 due to an attractive and repulsive force which is created by an interaction of a non-alternating (direct-current) magnetic flux generated from a fixed magnetic circuit and an alternating (alternating-current) rotating magnetic flux generated from the moving coil 5 which can move up and down in accordance with the Fleming's left-hand rule.

However, in the case of the electro-dynamic micro-speaker shown in FIG. 1*a,* it is not possible to perform an extensive reproduction of a low level sound and a high level sound which are required in the portable electronic appliance in view of a speaker structure when the electro-dynamic micro-speaker is manufactured into an ultra-micro-speaker for use in a camcorder, a notebook PC, a compact cassette recorder and an information communications portable terminal, for the following reasons.

For example, in the case that a speaker is 4 mm in height and 20 mm in diameter as shown in FIG. 1*c,* a bobbin 4 is set about 2.3 mm in length l and 9.5 mm in diameter. In this case, the whole length l of the bobbin is constructed so that a connection area a, a coil winding area b and a margin c between the coil 5 and a flexible wire 11 are allocated into 0.9 mm, 1.2 mm and 0.2 mm, respectively.

However, in the case that the flexible wire 11 of 0.8 mm in diameter is soldered with the coil 5 by a soldering lead, a vibration width d which makes a coil assembly 15 vibrate up and down is set 0.3–0.4 mm or so which is a distance between the flexible wire 11 and the upper end of the yoke 8.

If the coil assembly 15 vibrates with the set vibration width d or wider, the soldering portion 16 of the flexible wire 11 contacts the upper end of the yoke 8, to thereby cause so we call touch noise generated and lose the value of an acoustic reproduction product.

Thus, although there is a clearance of at least 0.7 mm between the lower end of the bobbin 4 and the bottom of the yoke 8 which can be increased according to the height of a permanent magnet 6 in the conventional art, an extension of a magnetic gap G lowers an efficiency of the speaker greatly. Accordingly, such an extension of the magnetic gap G has not been used.

The vibration width d cannot but limit an allowable input and the size of a magnet used is limited due to the limited vibration width d. As a result, it has not been possible to realize a high power and high efficiency speaker in view of its structure. Further, since a soft material has not been used for an edge of the vibration plate 3 in order to suppress a smooth vibration of the coil assembly 15, it has been difficult to lower a low band resonance frequency $f_0$ of the speaker in proportion to the stiffness of the edge.

Further, when the flexible wire 11 is used in order to supply a driving signal to the moving coil 5 from an external source, both ends of the flexible wire 11 is tightly fixed by a solid bonding material 12 and 13 and the intermediate portion of the flexible wire 11 is fixed to a vibration plate 3 by use of a soft bonding material 14 as shown in FIGS. 1*a* through 1*c*. However, when an excessive input signal is applied, the flexible wire 11 may be cut due to overheat.

For reference, in a commercially available receiver product, a rating input is 0.01–0.1 W in the case of a product having 20 mm or less in diameter, 0.2–0.5 W in the case of a product having 36 mm or so in diameter, and 0.5–1 W in the case of a product having 50–57 mm or less in diameter.

Also, in a high quality of a micro-speaker, a rating input is 0.2–0.3 W and the maximum input is 0.5 W in the case of a product having 20 mm in diameter.

As described above, as the size of the speaker grows smaller, a number of structural restrictions are caused. As a result, a low band resonance frequency $f_0$ becomes high and its efficiency and output are lowered.

Meanwhile, an electromagnetic speaker made using an electro-acoustic transducing theory and structure uses only a function of a buzzer for reproducing only a monotonous sound signal of 1 or 2 KHz, which is extremely narrow in actual applications.

For the above reasons, an ultra-compact speaker should appear soon in which a high efficiency multifunction of performing a broad band acoustic reproduction and receiving a large-scale input with an ultra-compact design can be integrated into a single unit in order to realize a compact personal information processing terminal where video, audio and office processing functions are integrated.

DISCLOSURE OF THE INVENTION

To solve the above-mentioned problems involved in the conventional electro-acoustic micro-transducer, it is an object of the present invention to provide an electro-acoustic micro-transducer having a three-mode broad band frequency reproduction feature, which can cover all acoustic reproduction functions of a buzzer, a receiver and a micro-speaker for a portable electronic device, with a single unit in which part of a yoke opposing a soldering portion between a flexible wire and a coil is cut out and simultaneously a soft material is used as edges of the incised yoke so that a coil assembly can be sufficiently vibrated up and down.

It is another object of the present invention to provide an electro-acoustic micro-transducer having a high power, high efficiency acoustic reproduction feature in which a coil assembly is not influenced by an allowable vibration width and a large-scale input is accepted.

It is still another object of the present invention to provide an electro-acoustic micro-transducer having a flat frequency characteristic over all reproduction frequency bands, by using a vibration diaphragm integrated with a reinforcing body.

It is yet another object of the invention is to provide an electro-acoustic micro-transducer having a structure in which a coil assembly and a frame assembly can be simply made, a coupling between a coil and a PCB is simple, and an excessive vibration can be sufficiently absorbed.

It is a further object of the present invention is to provide an electro-acoustic micro-transducer in which a rectangular flexible PCB having a pair of electrode patterns in order to solder both ends of the coil and a flexible wire is rolled and the rolled PCB is used as a bobbin.

To accomplish the above object, in accordance with one aspect, the present invention provides an electro-acoustic micro-transducer comprising: a yoke formed of an internal groove and a vertical incision portion for removing a predetermined vertical wall at at least one side surface; a permanent magnet installed in the groove of the yoke, for generating a non-alternating magnetic field; a plate mounted on the upper surface of the permanent magnet, for forming a magnetic gap between the outer circumferential surface and the upper end of the yoke; a coil wound on a bobbin, which generates an alternating magnetic field when an electric drive signal is externally applied via first and second lead wires and is disposed in the magnetic gap to be displaced up and down according to an interaction with a non-alternating magnetic field generated from the permanent magnet; a cylindrical frame in which the outer circumferential portion surrounds the yoke at the state where the yoke is set to be positioned in the center, the outer circumferential portion is perpendicularly extensively formed in such a manner that a groove is formed therein and an externally communicating throughhole is formed in the groove corresponding to the incision portion of the yoke; and a vibration diaphragm in which the bobbin is supported and the outer circumferential portion is supported in the upper end of the frame, for generating an acoustic sound in correspondence to the drive signal when the bobbin is displaced up and down, wherein spaces in the incision portion of the yoke and the frame are formed of a magnitude of preventing a connection portion between the coil and lead wire from contacting the bobbin during vertical vibration, to thereby extend an up-and-down vibration width of the bobbin.

Here, in the case that the bobbin is rectangularly formed, where first and second band type electrode patterns are lengthily separated and formed on the upper end of the bobbin and a flexible PCB substrate where a coil winding bonding material coating area is located is cylindrically molded and formed on the lower end thereof, both ends of the coil are connected to one end of each electrode pattern, the first and second lead wires are connected to the other end of each electrode pattern, and a single incision portion formed in the yoke is formed opposing the connection portion between the lead wires and the electrode pattern.

Here, in the case that the bobbin is rectangularly formed, where first and second band type electrode patterns are lengthily separated and formed on the upper end of the bobbin and a flexible PCB substrate where a coil winding bonding material coating area is located is cylindrically molded and formed on the lower end thereof, both ends of the coil are connected to one end of each electrode pattern, the first and second lead wires are connected to an opposing position of each electrode pattern with respect to the center of the bobbin, and first and second incision portions formed in the yoke are formed opposing the first and second connection portions between the lead wires and the electrode pattern.

Also, the flexible PCB substrate further comprises third and fourth band type electrode patterns electrically connected with the first and second band type electrode patterns in the inner side surface, for compensating for a linearity of DC magnetic field generated from the permanent magnet.

Further, the frame further comprises first and second guiders for molding the first and second lead wires withdrawn from the coil externally via each throughhole in zigzag form; and an electrode terminal plate in which the first and second lead wires withdrawn via each guider are connected to the lower surface of the frame in either side of the throughhole and first and second electrode pads via which drive signals are applied externally are separately formed, wherein the first and second guiders are removed at the state where the other ends of the first and second lead wires are fixed to the first and second electrode pads.

The vibration diaphragm comprises a body extended from a neck portion on which the bobbin is attached to an outer end in cone shape; a dust cap of a dome shape formed in the neck portion; a rib continuously protruded at a predetermined width and height from the center of the dust cap to the outer end of the body; and an edge for supporting the body to the frame, wherein the body, the dust cap, the rib and the edge are integrally formed.

The vibration diaphragm is formed in the same shape as those of the body and dust cap, and further comprises a reinforcing body attached to the lower end of the vibration diaphragm, having a hole corresponding to the center portion of the dust cap, for reducing a non-linear distortion of the vibration diaphragm.

Also, the vibration diaphragm is comprised of a separable body and an edge.

Meanwhile, the yoke and the frame can be integrated by a quality of a material in a magnetic path.

The electro-acoustic micro-transducer according to the present invention comprises a plurality of sound output holes and a cover plate combined in the lower end of the frame, for preventing foreign matter from entering the frame.

To accomplish the above object, in accordance with another aspect, the present invention provides an electro-acoustic micro-transducer comprising: a yoke formed of an internal circular groove and first and second vertical incision portions for removing a predetermined vertical wall at either side surface; a permanent magnet installed in the groove of the yoke, for generating a non-alternating magnetic field; a plate mounted on the upper surface of the permanent magnet, for forming a magnetic gap between the outer circumferential surface and the upper end of the yoke; a coil wound on a bobbin, which generates an alternating magnetic field when a drive signal is applied and is disposed in the magnetic gap to be displaced up and down according to an interaction with a non-alternating magnetic field generated from the permanent magnet; a cylindrical frame in which the outer circumferential portion surrounds the yoke at the state where the yoke is set to be positioned in the center, the outer circumferential portion is perpendicularly extensively formed in such a manner that a groove is formed therein and first and second externally communicating throughholes are formed in the first and second groove spaces opposing the incision portion of the yoke; and a vibration diaphragm in which the bobbin is supported and the outer circumferential portion is supported in the upper end of the frame, for generating an acoustic sound in correspondence to the drive signal when the bobbin is displaced up and down, wherein first and second spaces respectively formed by the first and second incision portions and the first and second groove spaces are formed of a magnitude of preventing first and second connection portions of the first and second flexible wires fixed to the bobbin from contacting the yoke and the frame during vertical vibration of the bobbin, in order to apply the drive signal externally, to thereby extend an up-and-down vibration width of the bobbin.

The electro-acoustic micro-transducer according to the present invention is applied to an ultra-compact and ultra-thin product.

The present invention can obtain a sufficiently allowable vibration width of the coil assembly by the cutting of the yoke, which makes the edge made of a soft material. Thus, a low level resonance frequency is lowered, to thereby obtain an acoustic reproduction capability of a broad band range in which all functions of a buzzer, a receiver and a micro-speaker are integrated.

Also, the present invention uses flexible wires via an incision portion by the cutting of the yoke to thereby very simply connect between the coil and the electrode terminal plate. As a result, a wire cut problem can be solved and a high withstand input can be accepted, to provide a new speaker structure having a high power and high efficiency feature.

Thus, the present invention can realize a personal information processing terminal in which all functions of video, audio and office processing are integrated.

BEST MODE FOR CARRYING OUT THE INVENTION

Preferred embodiments of the present invention will be described in detail hereinafter with reference to the accompanying drawings.

A. First embodiment

Figure 2:
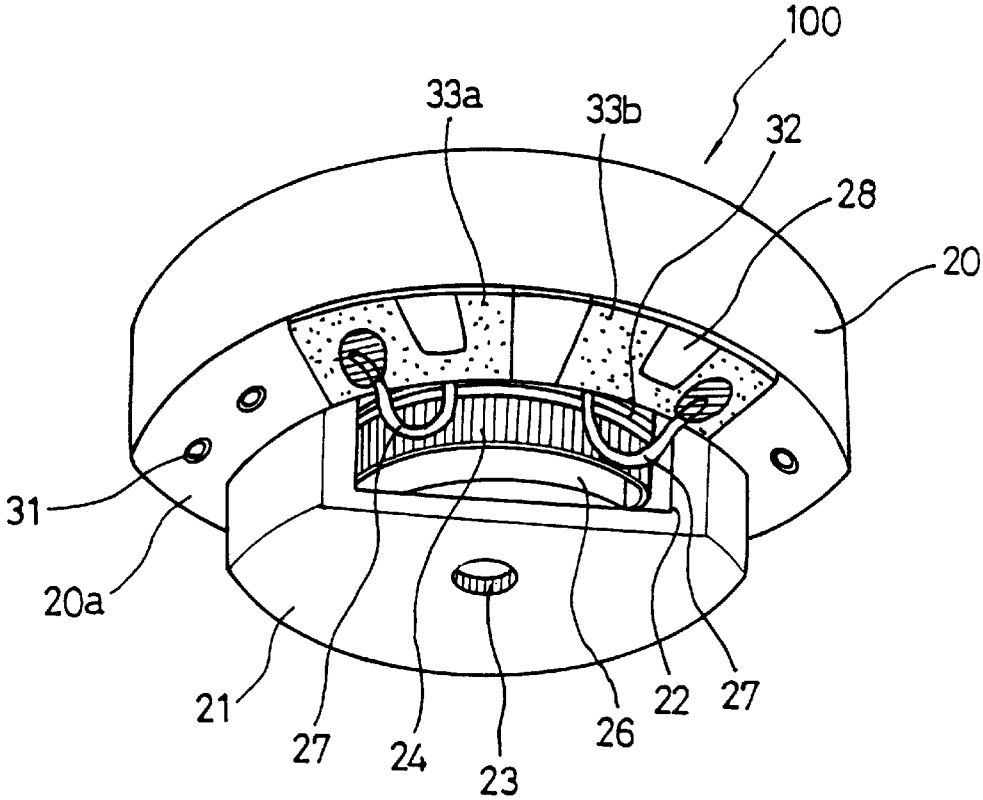
FIG. 2 is a perspective view of a micro-speaker according to a first embodiment of the present invention.
Figure 3A:
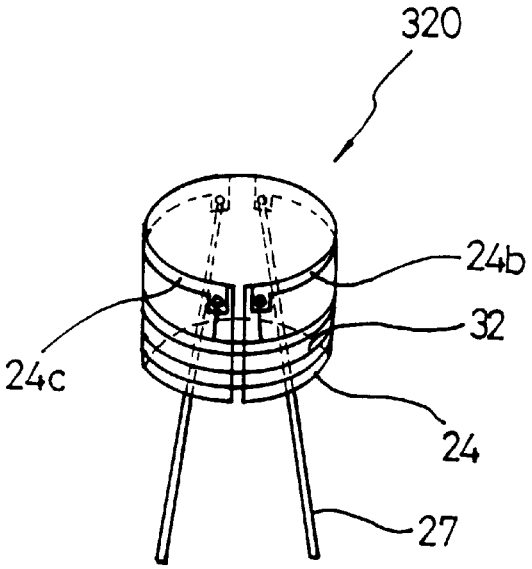
FIG. 3*a* is a perspective view showing a bobbin assembly used in the first embodiment.
Figure 3B:
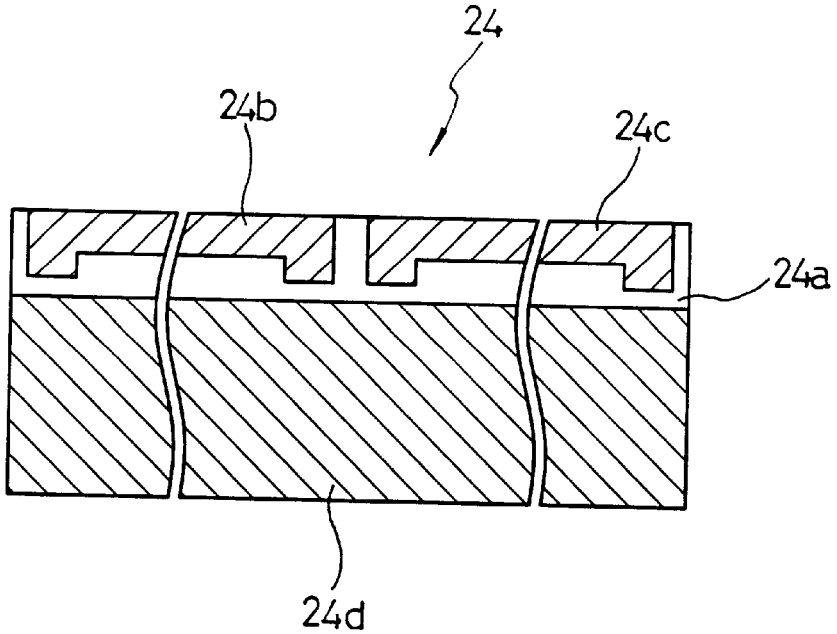
FIG. 3*b* is a plan view of the bobbin used in the FIG. 3*a* bobbin assembly.
Figure 4A:
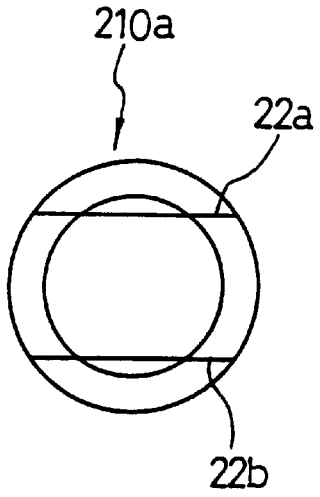
FIGS. 4*a* and 4b are plan view showing a cutting method of the yoke used in the present invention.
Figure 4B:
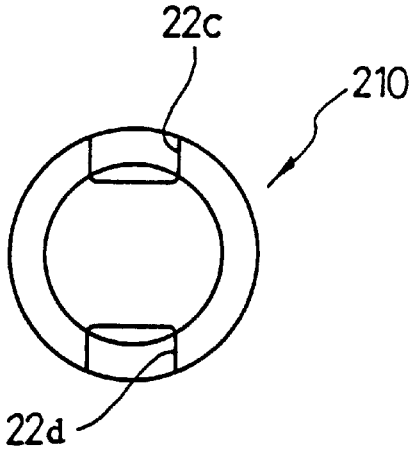
Figure 5A:
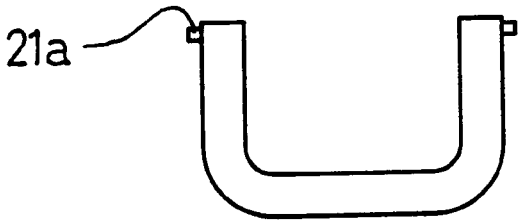
FIGS. 5*a* and 5*b* are sectional views showing the upper end shapes of the yoke used in the present invention.
Figure 5B:
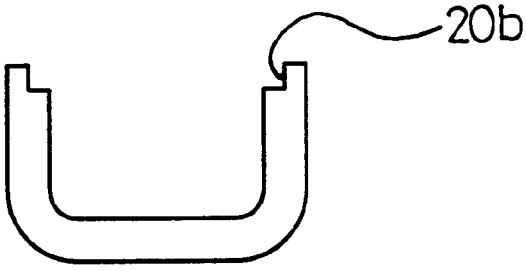

FIG. 2 is a perspective view of a micro-speaker according to a first embodiment of the present invention. FIG. 3*a* is a perspective view showing a bobbin assembly used in the first embodiment. FIG. 3*b* is a plan view of the bobbin used in the FIG. 3*a* bobbin assembly. FIGS. 4*a* and 4*b* are plan view showing a cutting method of the yoke used in the present invention. FIGS. 5*a* and 5*b* are sectional views showing the upper end shapes of the yoke used in the present invention.

Figure 7:
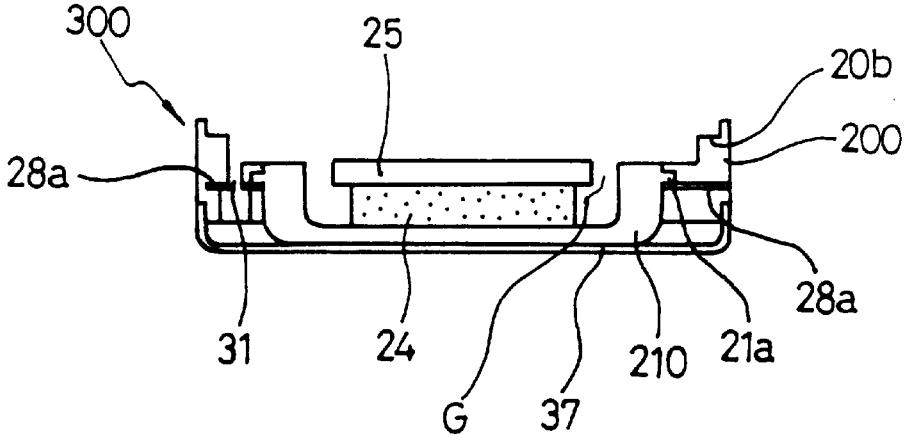
FIG. 7 is a cross-sectional view cut along line VII—VII of FIG. 6.

First, referring to FIGS. 2, 3*a* and 3*b,* a micro-speaker 100 according to the first embodiment of the present invention has a sectional structure similar to that of a second embodiment shown in FIG. 7. Accordingly, the internal structure of the speaker 100 will be described with reference to FIGS. 15*a* and 15*b*.

A frame 20 of the first embodiment is cylindrical and has a groove type structure therein, including a. step portion 20*b* for fixing an edge 43 of a vibration diaphragm 34. A front surface (an upper surface) of the frame 20 is open and a plurality of vent holes 31 are disposed in left and right sides on the bottom 20*a* of the frame 20 in order to perform smooth vibration of the diaphragm.

A cup-shaped yoke 21 is integrally molded by an insert molding method in the center of the bottom 20*a* of the frame 20, and a PCB 28 on which a pair of electrode patterns 33*a* and 33*b* are separately formed on one side of the bottom 20*a* of the frame 20.

One side of the yoke 21 is partly incised as shown in FIG. 2. As a result, although a soldering portion between a coil 32 formed in a bobbin 24 and a flexible wire 27 vibrates up and down, the soldering portion does not contact the yoke 21, to thereby prevent a touch noise phenomenon.

In the first embodiment, the yoke 21 is a non-symmetrical structure in which a single incision portion 22 is formed on one side. However, as shown in FIG. 4*a,* a pair of incision portions 22*a* and 22*b* are formed on each side of the yoke 21 by linearly cutting the yoke 21. As shown in FIG. 4*b,* a pair of incision portions 22*c* and 22*d* having a symmetrical structure are formed on each side of the yoke 21 by cutting the yoke 21 in a curved shape, in which an area of incision is minimized as much as possible to increase a magnetic density (see a second embodiment).

Also, the upper end of the yoke 21 has a flat structure or an inward step structure as shown in FIGS. 5*a* and 5*b*. A guide 21*a* formed on the upper end outer circumferential portion plays a role of preventing the yoke 21 from being swayed when the frame 20 is molded by an insert molding method. A vent hole 23 is formed in the center of the groove of the yoke 21.

A disc-shaped permanent magnet 26 is mounted in the inner side of the groove of the yoke 21. A disc-shaped plate 25 is fixed on the upper portion of the permanent magnet 26, in order to focus a magnetic force of the magnet on a magnetic gap G to thereby enhance a transducing efficiency. The yoke 21 and the plate 25 are made of the same material as that of a magnetic path (refer to FIG. 7).

Figure 15A:
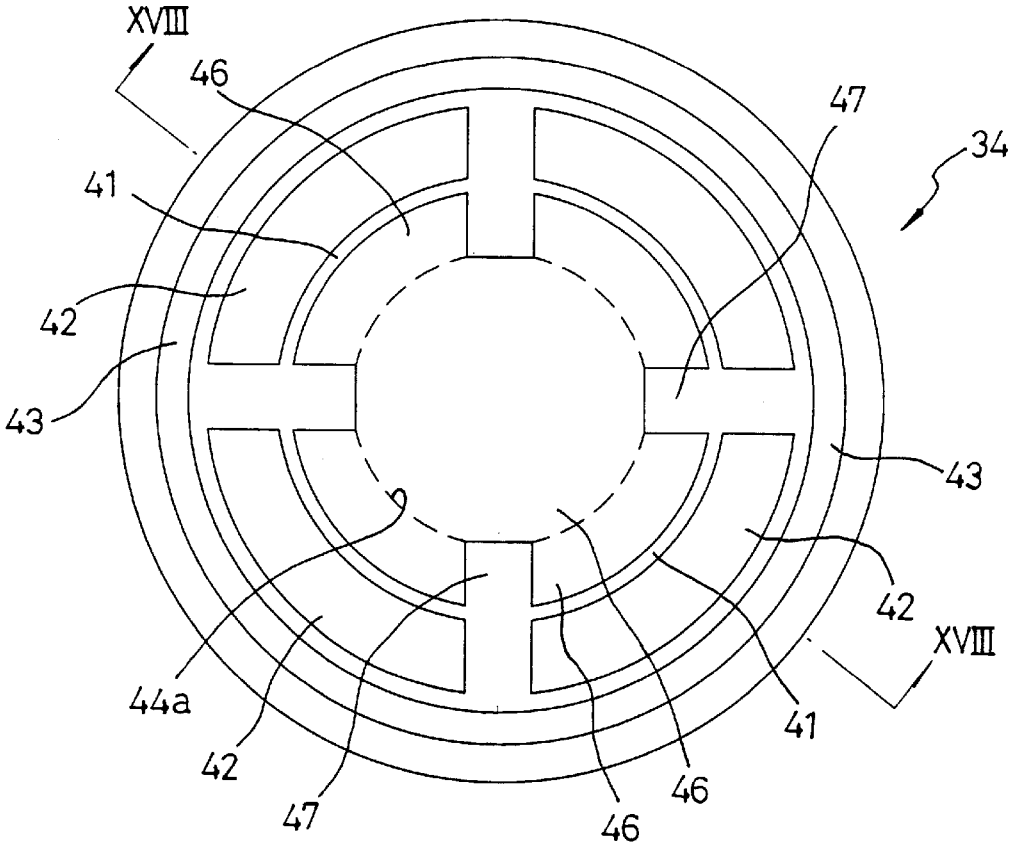
FIG. 15*a* is a plan view of a diaphragm used in the first and second embodiments.
Figure 15B:
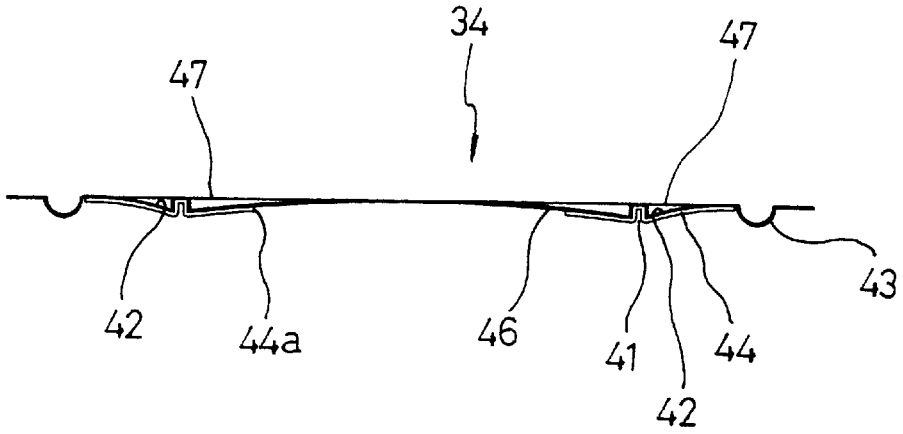
FIG. 15*b* is a crossing-sectional view cut along line XV—XV of FIG. 15*a;*

Meanwhile, the upper end of the bobbin 24 is fixed to a neck portion 41 of the vibration diaphragm 34 so that the bobbin 24 in which a voice coil 32 is wound at the outer circumferential portion is positioned in the magnetic gap G (refer to FIGS. 15*a* and 15*b*).

In the bobbin 24 as shown in FIGS. 3*a* and 3*b,* a pair of mutually separated conductor electrode pattern 24*b* and 24*c* such as a copper thin film are formed on the upper end of the substrate 24*a*. A flexible PCB on which a bonding coating area 24*d* is formed in order to maintain the state where the wound coil 32 is attached to the substrate 24*a* is mounted on the lower end of the substrate 24*a*. During use, the flexible PCB substrate 24*a* is molded in cylindrical form and then the coil 32 is wound around the outer circumferential portion of the bonding coating area 24*d* of the bobbin 24.

Thereafter, both ends of the coil 32 are fixed to one side pad of each electrode pattern 24*b* or 24*c* by soldering or welding. A protective molding processing is performed in the upper end of the fixed portion. Then, a pair of flexible wires 27 are fixed in the same manner to the other pad of the electrode patterns 24*b* and 24*c*.

Thus, the coil 32 and the flexible wire 27 can be connected and fixed in simpler manner. However, in this case, it is preferable that a balance weight is added in one side pad of the opposed electrode pattern in which the flexible wire 27 is attached so that the gravitational center of the bobbin 24 is positioned on the axis.

In the present invention, it is preferable that a residual wire of the coil 32 is used to connect between the coil 32 and the electrode patterns 33*a* and 33*b* on the PCB 28, instead of using the flexible wire.

It is preferable to use a super voice (SV) wire, a high heat resistant product such as PE and TE as the material of the coil 32. The flexible PCB substrate 24*a* can be made of a product of a high heat resistance and polymer material such as polyethylene imid (PEI), polyimid (PI), and CAPTON.

In this case, the vibration diaphragm 34 is of a structure of preventing a division vibration in a high level sound area where a reinforcing body 44 is attached to the lower end surface, in addition to a structure in which a circular body 42 and a down roll type edge 43 for supporting the body 42 to the step portion of the frame 20 are integrally formed, which will be described in more detail. Or, a general vibration diaphragm comprised of a body and an edge can be used.

In the case of the separable body 42, a polymer material such as PE, PET, polycarbonate (PC), PEI, PI, CAPTON or a metallic material of inverse magnetism and counter-magnetism such as Ti, Al, duralumin, stainless steel, brass and bronze.

The sectional shape of the edge 43 can be an up roll type, flat type, wave type in addition to the down roll type. Also, the edge is a gasket integration type for performing a buffer function, whose material is a silicon polymer series resin, textile and rubber.

In this case, the body 42 and the edge 43 in the vibration diaphragm 34 can be separately fabricated and then coupled, or manufactured integrally.

Further, a gasket 35 made of rubber or EVA material for fixing the edge 43 can be used additionally.

Figure 1A:
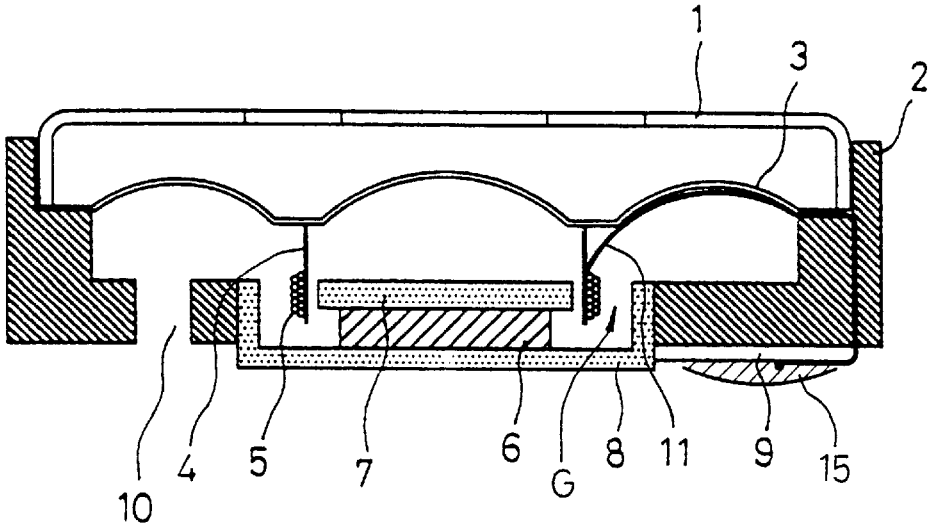
Fig. 1a (PRIOR ART)
FIG. 1*a* is a sectional view showing a conventional electrodynamic type speaker.
Figure 1B:
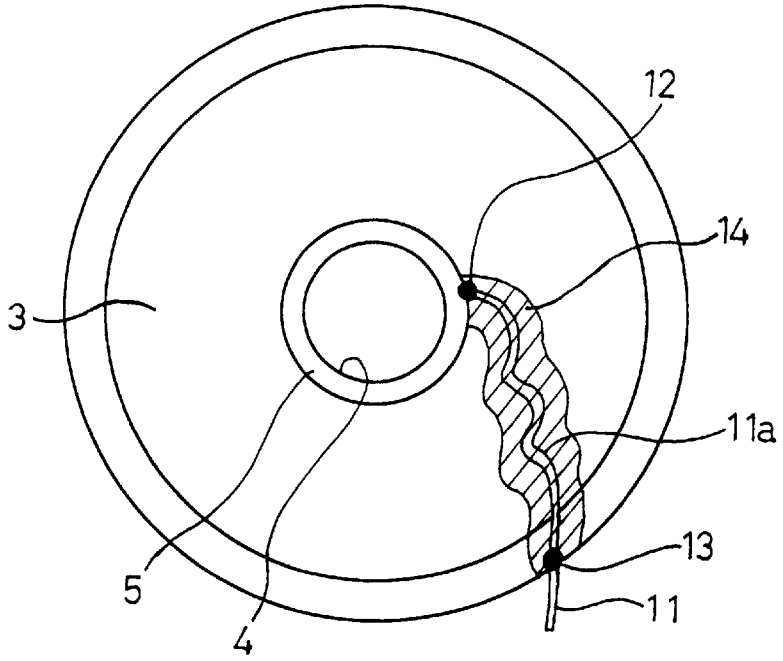
Fig. 1b (PRIOR ART)
FIG. 1*b* is a rear view showing a structure of fixing a coil wire of FIG. 1*a;*
Figure 1C:
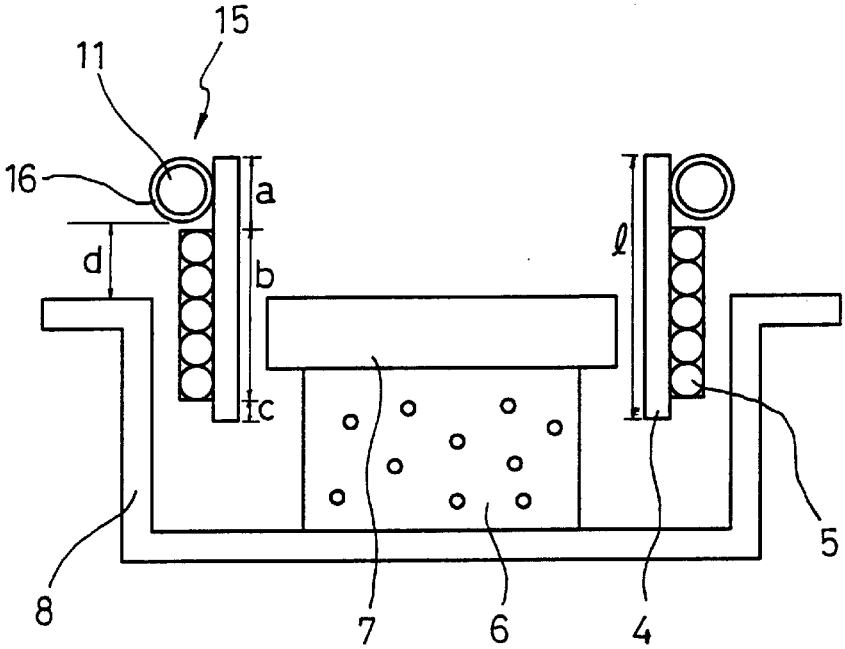
Fig. 1c (PRIOR ART)
FIG. 1*c* is an enlarged view of a bobbin of FIG. 1*a;*

Meanwhile, in the present invention, a pair of flexible wires 27 connected to both ends of the coil 32 are not led outside of the frame along the conventional vibration diaphragm as shown in FIG. 1*a,* but withdrawn downwards from the bobbin 24 and then fixed directly to a pair of electrode patterns 33*a* and 33*b* of the PCB 28 via the incision portion 22 of the yoke 21.

In the first embodiment having the above structure, a pair of flexible wires 27 withdrawn from the coil 32 are withdrawn via the incision portion 22 of the yoke 21. As a result, a touch phenomenon occurring when the portion where the flexible wire 27 has been soldered to the electrode patterns 24*b* and 24*c* contacts the upper end of the yoke 21 as in the conventional art, is not generated.

Thus, the bobbin 24 of the coil assembly 320 can vibrate up to the lower end of the yoke 21 up and down. Accordingly, an allowable vibration width is greatly increased. Further, the present invention does not need to be concerned about a touch phenomenon. Thus, since it is possible to increase the size of the magnet 26 for reinforcing a magnetic force of a magnetic circuit, in particular, to increase the thickness, the vibration width of the coil assembly 320 can be increased furthermore.

As a result, the vibration width of the present invention is 1.5 mm . In the case that the thickness of the magnet 26 is increased, the vibration width can be obtained up to 2 mm at maximum. The vibration width allows an allowable input to be increased with respect to the speaker coil 32. Accordingly, it is possible to reproduce a nominal power as 1.5–2 W at 20 mm diameter class.

In the present invention, an efficiency is lowered due to the incision of the yoke 21. However, since the present invention increases a magnetic circuit greatly, an increase of the efficiency can be expected rather than lowering of the efficiency due to the incision of the yoke.

Further, since the vibration width can be increased in the present invention, a soft material can be used in the edge 43 of the vibration diaphragm 34. In general, since a low band resonance frequency $f_0$ of a speaker is proportional to a stiffness which is inverse to a compliance of the edge as can be seen from the following equation 1, a low band resonance frequency $f_0$ of the present invention is lowered. That is, a reproduction bandwidth is increased.

B. Second embodiment

Referring to FIGS. 6 through 11, a second embodiment 300 has a symmetrical yoke incision structure, while the first embodiment 100 is a non-symmetrical single yoke incision structure, which is the most crucial different point.

Figure 12A:
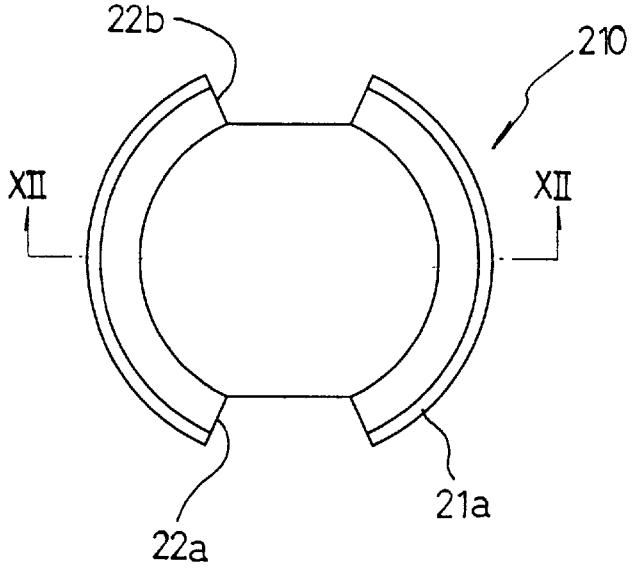
FIGS. 12*a* through 12*c* are a plan view and a side view of the yoke used in the second embodiment and a cross-sectional view cut along line XII—XII of FIG. 12*a,* respectively.
Figure 12B:
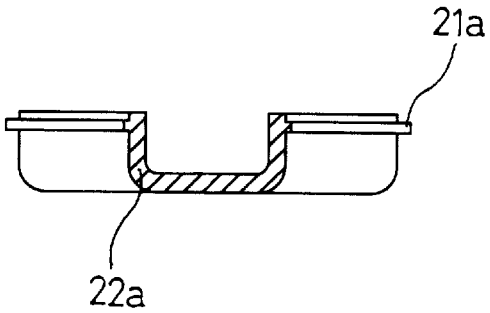
Figure 12C:
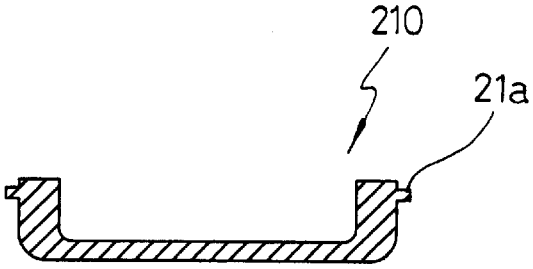

A yoke 210 in the second embodiment has a structure in which a pair of incision portions 22*a* and 22*b* are symmetrical on both sides and a guide 21*a* is formed on the upper end circumferential portion, as shown in FIGS. 12*a* through 12*c*.

Figure 14A:
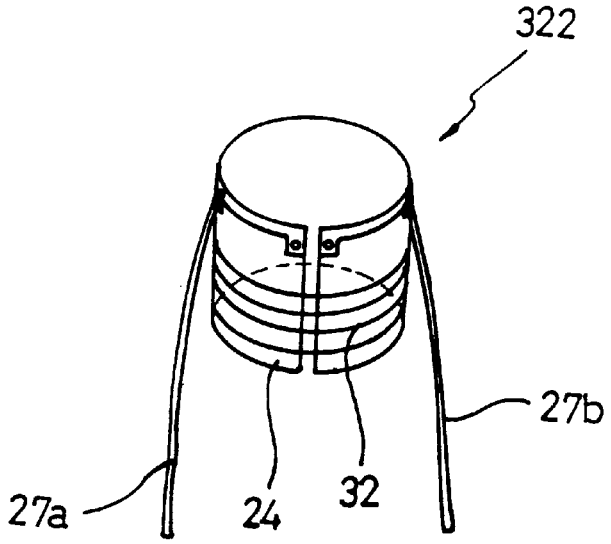
FIG. 14*a* is a perspective view showing a bobbin assembly used in the second embodiment.
Figure 14B:
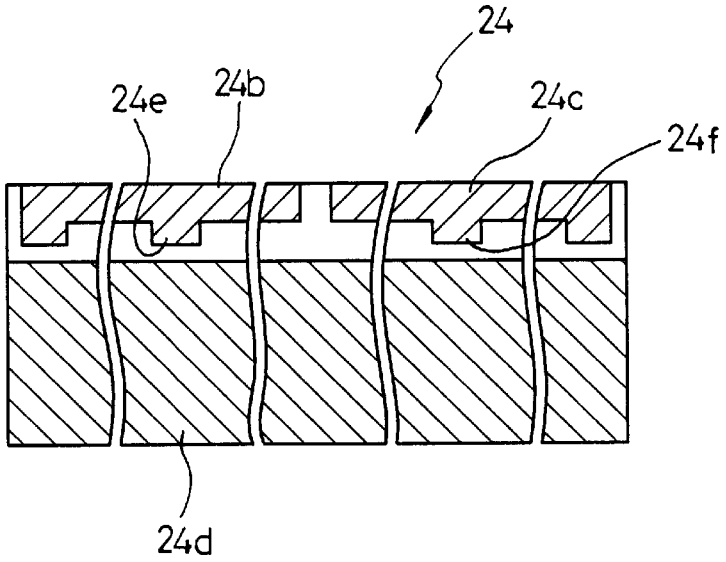
FIG. 14*b* is a plan view of the bobbin used in FIG. 14*a;*

Since the incision portions 22*a* and 22*b* of the yoke 210 are positioned respectively in both sides, a coil assembly 322 used in the second embodiment 300 has a structure similar to the bobbin of the first embodiment 100 as shown in FIG. 14*b*. As a different point between the bobbins of the first and second embodiments, fixing pads 24*e* and 24*f* for fixing a flexible wire 27 to the electrode patterns 24*b* and 24*c* of the bobbin 24 is not collected at one side only as in the first embodiment, but they are formed in the center of the electrode patterns 24*b* and 24*c* so as to be positioned in mutually opposing sides when they are cylindrically formed in order to wind the coil 32.

The coil assembly 322 is fabricated in the same manner as that of the first embodiment 100, and then obtained as shown in FIG. 14*a*. In this case, since a pair of flexible wires 27*a* and 27*b* are soldered or welded to the fixed pads 24*e* and 24*f*, which are disposed in the positions opposing each other, a separate balance weight is not needed.

Figure 13:
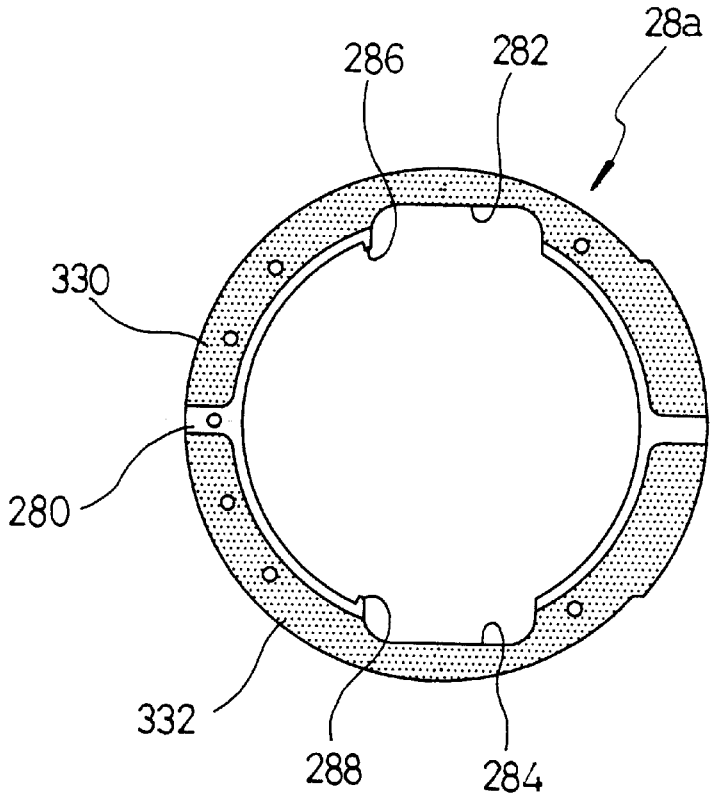
FIG. 13 is a plan view of a PCB used in the second embodiment.

Meanwhile, in the case of a PCB 28*a* which is formed by an insert-molding method together with the yoke 210 in the second embodiment 300, the incision portions 22*a* and 22*b* of the yoke 210 and the flexible wires 27*a* and 27*b* of the coil assembly 322 are symmetrically formed in both sides of the bobbin 24 as shown in FIG. 13. Accordingly, a pair of semi-circular electrode patterns 330 and 332, which can oppose the incision portions 22*a* and 22*b* and the flexible, wires 27*a* and 27*b* are separately formed on an annular substrate 280.

Also, grooves 282 and 284 are formed on both sides of the substrate 280 with which the flexible wires 27*a* and 27*b* are connected in order to prevent a touch phenomenon. Anti-rotation protrudes 286 and 288 are protruded and formed in one side of the grooves 282 and 284, in order to prevent the yoke 210 from rotating when it is engaged with the yoke 210 to perform an insert molding method.

Figure 6:
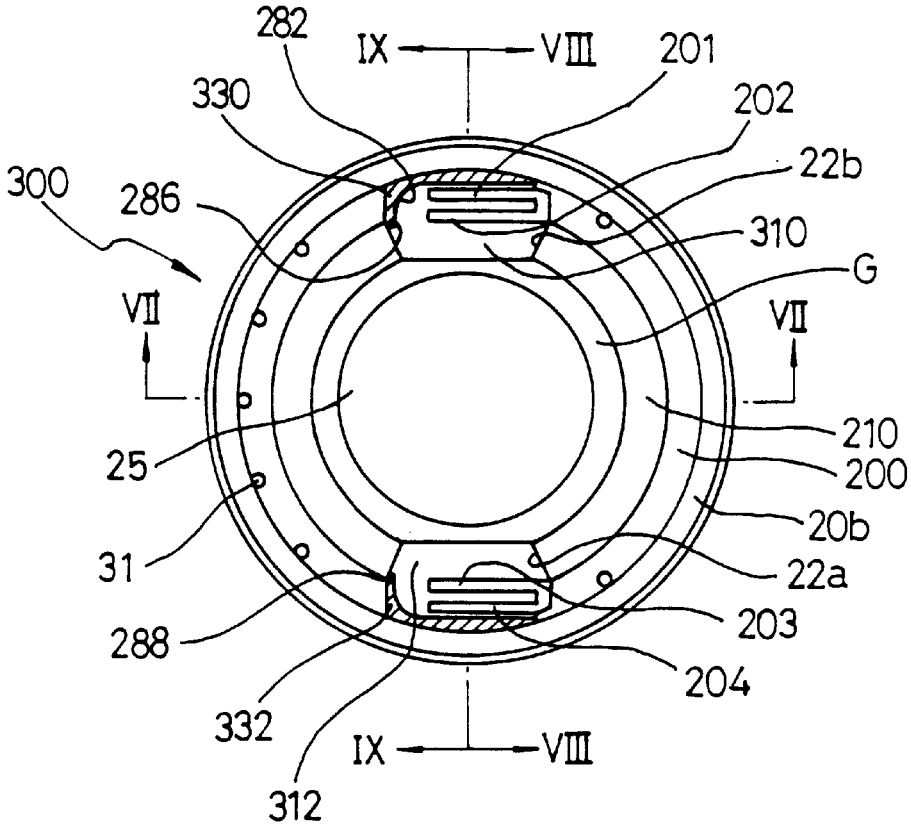
FIG. 6 is a plan view of a micro-speaker according to a second embodiment of the present invention, in which a vibration diaphragm is removed.

A frame 20 which is integrally formed by an insert molding method so as to accommodate the yoke 210 and the PCB 28*a* is shown in FIG. 6. In FIG. 6, a pair of wire guides 201–204 extended from the frame 200 having a respectively height difference are horizontally extended in piercing space portions 310 and 312 formed by the incision portions 22*a* and 22*b* at both sides of the yoke 210.

Figure 8:
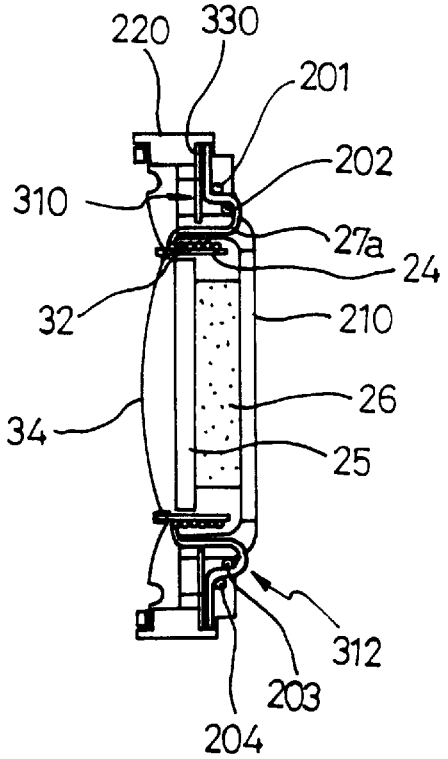
FIG. 8 is a cross-sectional view cut along line VIII—VIII of FIG. 6.
Figure 9:
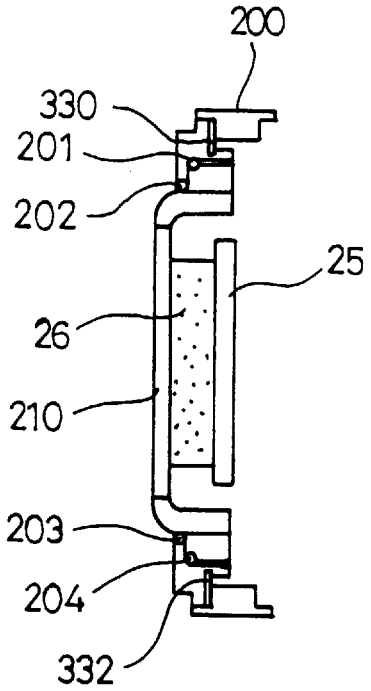
FIG. 9 is a cross-sectional view cut along line IX—IX of FIG. 6.

In the second embodiment 300, the flexible wires 27*a* and 27*b* withdrawn from the coil assembly 322 passes between the wire guides 201 and 202 or 203 and 204 in the piercing space portions 310 and 312 in S shape, respectively as shown in FIG. 8, and then the leading end is soldered and fixed to the electrode pattern 330 of the PCB 28*a*. Thereafter, if the wire guides 201–204 are cut and removed, the flexible wires 27*a* and 27*b* connect between the coil 32 and the electrode patterns 330 and 332 of the PCB 28*a* with a sufficient length when the coil assembly 322 vibrates up and down.

Figure 10:
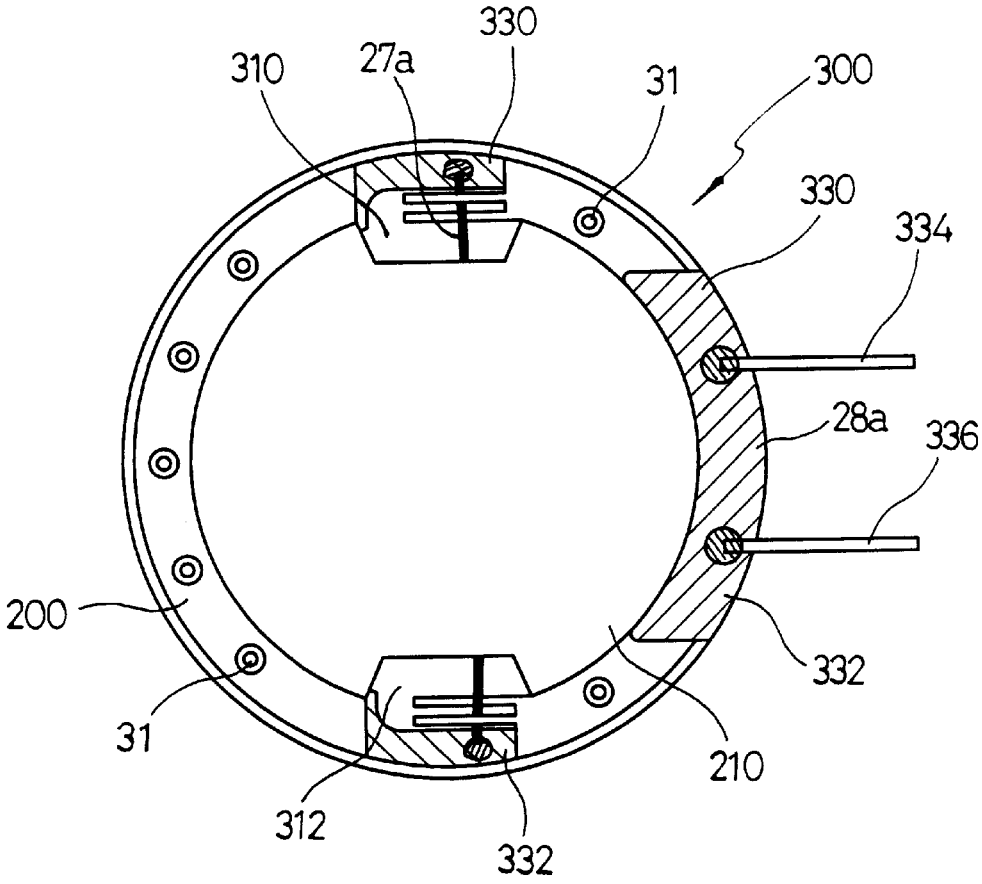
FIG. 10 is a bottom view of FIG. 6.
Figure 11:
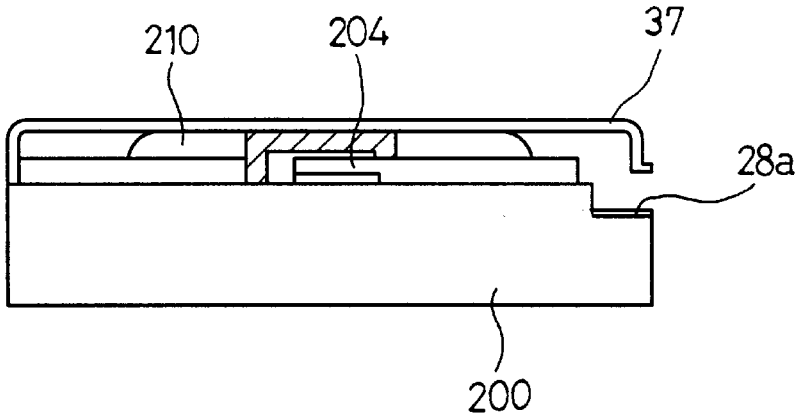
FIG. 11 is a side view of FIG. 6.

In the second embodiment 300, a sound output applied from an external source, for example, a main PCB in a set where a speaker is used, is supplied when electrode terminals 334 and 336 are connected to the electrode patterns 330 and 332 exposed in one side of FIG. 10.

As a result, although the bobbin vibration diaphragm 34 vibrates in any manner up and down according to an excessive input, a wire cutting phenomenon does not occur, and confronts elastically with an elastic force. Thus, even if an allowable input is limited due to the wire cutting phenomenon in the prior art, the present invention accepts a high withstand input due to such little restriction, rendering a high power characteristic.

Figure 16A:
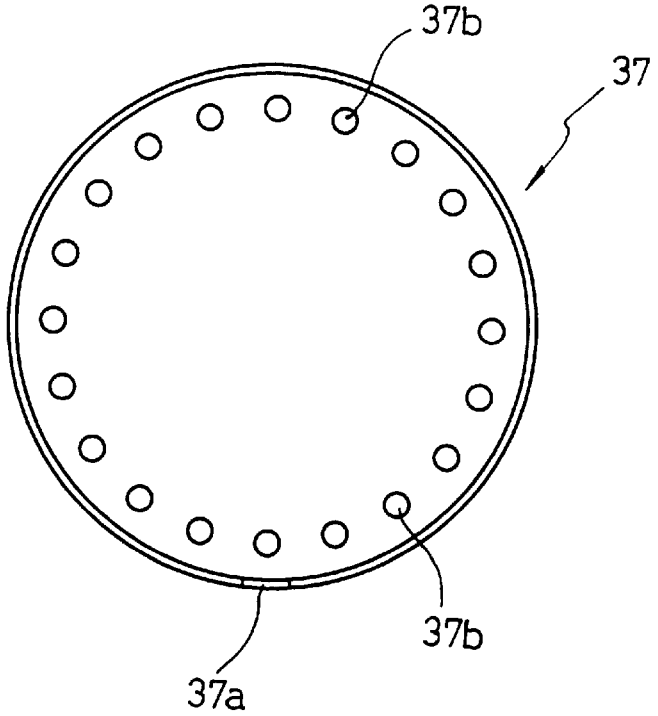
FIGS. 16*a* and 16*b* are a plan view and a side view of a cover plate used in the first and second embodiments.
Figure 16B:
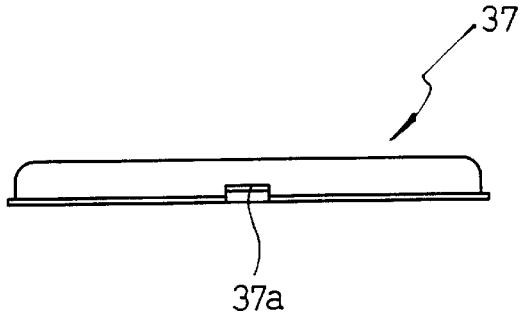

In addition, since the incision portions are formed in the yokes 21 and 210, respectively in the first and second embodiments, a cover plate 37 shown in FIGS. 16*a* and 16*b* is combined in the lower sides thereof, in order to prevent dust or foreign matter from being intruded into the speaker.

A groove 37*a* through which the electrode terminals 334 and 336 are withdrawn is formed in one side of the cover plate 37 and a plurality of sound vent holes 37*b* are pierced and formed.

Meanwhile, a plan view of the vibration diaphragm of the present invention used commonly in the first and second embodiments is shown in FIG. 15*a* and its sectional view is shown in FIG. 15*b*.

In the embodiment, the vibration diaphragm 34 is comprised of an edge 43, a body 42 formed between the edge 43 and a neck 41, and a dust cap 46 formed in the inside of the neck 41 in integral form. A division resonance prevention crossing type rib 47 is integrally formed around the center circumferentially between the body 42 and the dust cap 46, which can be manufactured using a polymer series film material having an excellent restoring force, preferably.

Also, it is preferable that the lower side of the vibration diaphragm 34 is manufactured using a solid and light material such as AL, Ti, duralumin, pulp, and polymer material, in the same pattern as that except for the edge of the vibration diaphragm 34. A vibration diaphragm reinforcing body 44 having an opening 44*a* is attached in the intermediate portion of the dust cap 46.

The body 42 of the vibration diaphragm 34 is in the form of a cone type as shown in FIG. 15*a*, the dust cap 46 is in the form of a dome type, and the crossing type rib 47 is flush in the form of an identical plane level from the down roll type edge 43 to the opposing edge 43 crossing over the center of the vibration diaphragm, and has a shape having predetermined width and protruded from the body 42.

Also, the bobbin 24 around which the coil 32 is wound is combined with and fixed to the neck portion 41 of the vibration diaphragm reinforcing body 44, that is, a boundary portion between the body 42 and the cap 46.

The vibration diaphragm is reinforced by the crossing type rib 47 and thus the whole mechanical twisting phenomenon of the body 42 can be minimized when the vibration diaphragm 34 vibrates up and down. As a result, a normal oscillation can be realized in a low level sound region and a division resonance can be suppressed in a middle or high level sound region.

In the speaker having the vibration diaphragm according to the present invention, it is possible to generate a sound so as to have a constant, that is, flat frequency characteristic all over the whole reproducible frequency bands. Further, a secondary harmonic component can be greatly reduced according to suppression of a division resonance, thereby making it possible to regenerate a clear and plain sound.

In this embodiment, an example in which the vibration diaphragm reinforcing body 44 is attached has been described. However, it is possible to the vibration diaphragm 34 integrally without having the vibration diaphragm reinforcing body 44.

Since the second embodiment has a structure of a yoke and a coil assembly, similar to those of the first embodiment basically, a high power output characteristic according to an increase of an extension of the low band resonance frequency $f_0$ and an increase of an allowable input.

The operational principle and function with respect to the first and second embodiments according to the present invention will be described in detail hereinafter.

C. High efficiency electro-acoustic transducing principle and broad band reproducing structure.

In the micro-speaker according to the present invention, the coil assemblies 320 and 322 can vibrate sufficiently according to an input signal without any limit and the size of the magnet 24 can be increased. Therefore, a conversion efficiency SPL of the speaker can be enhanced when compared with the conventional art.

Further, in the first and second embodiments, a stiffness so becomes small at the low band resonance frequency $f_0$ of the speaker which is determined as the following equation (1). Accordingly, the low band resonance frequency $f_0$ of the speaker becomes low. As a result, a reproduction sound frequency band of the speaker is extended.

$$f_0 = \frac{1}{2\pi}\sqrt{\frac{so}{mo}} \quad [\text{Hz}] \tag{1}$$

In equation (1), "so" represents stiffness which is an inverse of the compliance of the edge 43 in the speaker. Here, the smaller stiffness the more compliance. Then, "mo" represents the equivalent mass of the vibrating system expressed by the sum of the weight of the coil 32, half the weight of the edge 43, the weight of the bodies 42 and 44, and an additional mass resulting from a reaction of air ($8/3\times1.23\times a^3$ (Kg)). Here, "a" represents a radius of a vibrating diaphragm.

Also, the vibration diaphragm 34 has a large offset angle θ of the neck 41, and can extend the loud resonance frequency band of the speaker in proportion to adjustment of the elastic modulus (Young's modulus) E. Accordingly, the speaker according to the present invention can accomplish extension of a substantial reproduction sound frequency band.

Thus, the low band resonance frequency $f_0$ of the speaker becomes lowered and the high band resonance frequency fh is increased, to thereby extend low and high band sound.

In the case that the speaker unit according to the present invention having the above-described structure is embodied into 20 mm in diameter and 4.1 mm in height, it has been ascertained that a reproduction frequency band measured in free field meets 200 Hz–16 KHz.

Thus, in view of a frequency characteristic, the speaker according to the present invention has all frequency characteristics which are required in a micro-speaker, receiver and buzzer.

D. Reduction of second and third harmonic distortion

In a speaker, as a reproduction frequency generally becomes high, an unbalanced vibration or division vibration occurs in the left and right of the vibration diaphragm, with a result that a nonlinear distortion is generated in the vibrating system.

Since the nonlinear distortion phenomenon influences upon a second harmonic distortion by which lucidity of the reproduction sound is determined, it is preferable to lower the nonlinear distortion phenomenon.

In the present invention, since the vibration diaphragm is balanced by the crossing type rib 47 and the vibration diaphragm reinforcing body 44, the second harmonic distortion is reduced to then make the reproduction sound lucid.

Meanwhile, in the case that the DC magnetic flux of the permanent magnet is relatively smaller than the rotational magnetic field of the coil, a linearity of the DC magnetic flux flowing from the plate to the yoke is distorted. The DC magnetic flux linearity distortion causes a third harmonic distortion influencing upon a sound tone during reproducing of the original sound.

Figure 17A:
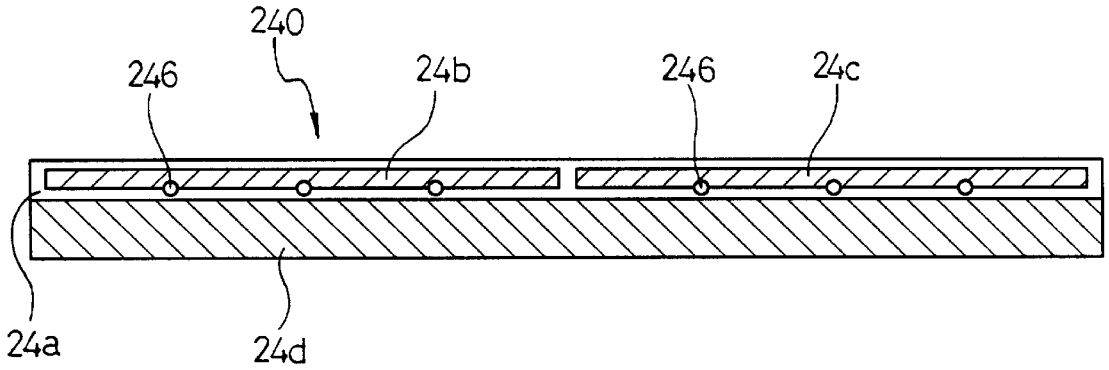
FIG. 17*a* is a plan view of another flexible PCB substrate used in the bobbin of the present invention.
Figure 17B:
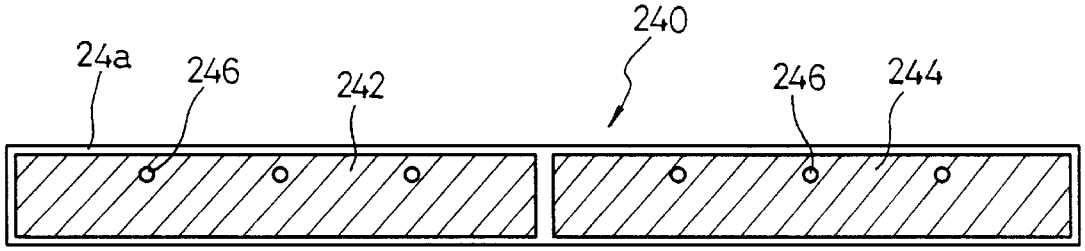
FIG. 17*b* is a bottom view of FIG. 17*b;*

As shown in FIGS. 17*a* and 17*b* according to the present invention, a flexible PCB substrate 24*a* forming a bobbin 240 is two-faced substrate, in which the outer face has the same structure as that of the bobbin 24 of the first and second embodiments but the inner face is formed of DC magnetic flux focusing conductive patterns 242 and 244 as shown in FIG. 17*b*, in which the conductive patterns 242 and 244 are electrically connected with the electrode patterns 24*b* and 24*c* via a plurality of throughholes 246, respectively.

As described above, in the case that a coil assembly is manufactured at the state where the conductive patterns 242 and 244 have been formed in the inner face of the bobbin 240, to complete a speaker, if a rotational magnetic field increases in proportion to the current applied to the coil 32, the conductive patterns 242 and 244 focuses the DC magnetic flux of the permanent magnet flowing from the plate 25 to the yoke 21 or 210, in proportion to the increased rotational magnetic field, thereby compensating for a phenomenon that the DC magnetic flux becomes relatively smaller than the rotating magnetic field of the coil 32.

As a result, a linearity distortion phenomenon of the DC magnetic flux flowing from the plate to the yoke is suppressed. Accordingly, since the third harmonic distortion can be reduced more than in the prior art, a reproduction much closer to the original sound can be accomplished.

E. Prevention of coil cutting phenomenon and acceptance of large input

In the compact speaker according to the present invention, the flexible wires 27, 27*a* and 27*b* withdrawn from the coil 32 are not fixed to the body of the vibration diaphragm, but are fixed to the PCBs 28 and 28*a* via the piercing space portions 310 and 312, in zigzag form while having a length sufficient for up-and-down vibration of the coil 32. It is possible for the coil assembly to vibrate with a sufficient vibration width due to the incision of the yokes 21 and 210.

Thus, the coil 32 can be prevented from being cut. Also, since the allowable input is not limited due to the wire cut and the touch phenomenon, a high withstand input can be accepted to thereby provide a high power characteristic.

As a result, the present invention can accept a large input of a rating input 2 W even in the ultra-micro-speaker of 20 mm in diameter.

F. Third embodiment

Figure 18A:
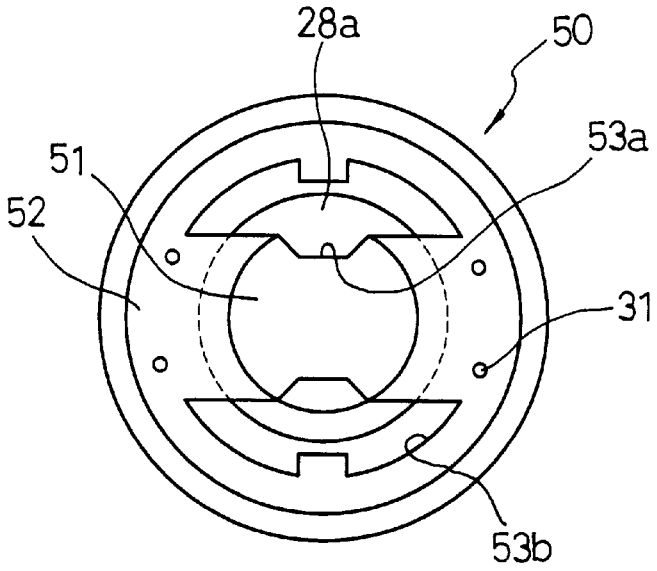
FIG. 18*a* is a plan view of a micro-speaker according to a third embodiment of the present invention.
Figure 18B:
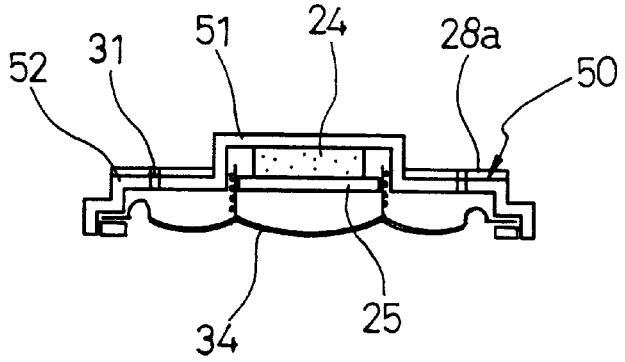
FIG. 18*b* is a crossing-sectional view cut along XVIII—XVIII of FIG. 18*a.*

FIGS. 18*a* and 18*b* show a third embodiment of the present invention.

The same elements in the third embodiment as those of the first and second embodiments are assigned with same reference numerals as those of the first and second embodiments. Thus, the detailed description of the same elements will be omitted, and only the differences will be described.

As shown in the drawings, the micro-speaker in the third embodiment is comprised of an integrated yoke/frame 50 in which a yoke 51 and a frame 52 are integrated into a single body, differently from the first and second embodiments. This is fabricated using a cold or hot rolling or casting method with a ferromagnetic magnetic path material.

Thereafter, incision portions 53*a* and 53*b* are symmetrically formed in both sides of the yoke 51 and a PCB 28*a* is combined in the lower surface of the frame 52, in the same manner as in the second embodiment. The coil assembly and the vibrating diaphragm 34 have the same structure as those of the second embodiment.

Thus, connection between the coil assembly 322 and the PCB 28*a* is accomplished in the same manner as that of the second embodiment. Of course, it is possible for the third embodiment to adopt a structure forming an incision portion in one side of the yoke as in the first embodiment.

The third embodiment includes the structure similar to those of the first and second embodiments, to thus provide the effect similar to those of the first and second embodiments.

The above-described embodiments have been designed with a frame having a speaker unit formed of a light, thin, short and small shape in whole, but can be applied to a speaker unit having a large scale size, high power and high transducer efficiency.

Industrial Applicability

The basic concept of the present invention resides in the points that at least one incision portion is formed at the side of the yoke in order to increase the vibration width of the coil assembly and prevent a touch phenomenon, the bobbin is formed using a flexible PCB substrate, and the vibration diaphragm is adopted in order to enhance an original sound reproduction capability, which can be applied to any kind of an electro-acoustic transducer.

As described above, the present invention provides a micro-speaker capable of performing a broad band reproduction of a large input/large output, high efficiency and 3-mode, in an ultra-compact size, by modification of the yoke and frame structure.

Accordingly, the present invention does not require a micro-speaker, receiver and buzzer separately, which can be replaced by a single unit, to thereby reduce the number of the whole components mounted in the set for acoustic reproduction and enable development of an up-to-date portable electronic product possessing a more enhanced acoustic reproduction capability.

In addition, the present invention can use a rectangular flexible PCB which can be wound as a bobbin, to thereby provide an electro-acoustic transducer which can be simply manufactured.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. An electro-acoustic micro-transducer comprising:

a yoke formed of an internal groove and a vertical incision portion for removing a predetermined vertical wall at at least one side surface;

a permanent magnet installed in the groove of the yoke, for generating a non-alternating magnetic field;

a plate mounted on the upper surface of the permanent magnet, for forming a magnetic gap between the outer circumferential surface and the upper end of the yoke;

a coil wound on a bobbin, which generates an alternating magnetic field when an electric drive signal is externally applied via first and second lead wires and is disposed in the magnetic gap to be displaced up and down according to an interaction with a non-alternating magnetic field generated from the permanent magnet;

a cylindrical frame in which the outer circumferential portion surrounds the yoke at the state where the yoke is set to be positioned in the center, the outer circumferential portion is perpendicularly extensively formed in such a manner that a groove is formed therein and an externally communicating throughhole is formed in the groove corresponding to the incision portion of the yoke; and a vibration diaphragm in which the bobbin is supported and the outer circumferential portion is supported in the upper end of the frame, for generating an acoustic sound in correspondence to the drive signal when the bobbin is displaced up and down, wherein spaces in the incision portion of the yoke and the frame are formed of a magnitude of preventing a connection portion between the coil and lead wire from contacting the yoke during vertical vibration, to thereby extend an up-and-down vibration width of the bobbin.

2. The electro-acoustic micro-transducer according to claim 1, wherein the bobbin is rectangularly formed, where first and second band type electrode patterns are lengthily separated and formed on the upper end of the bobbin and a flexible PCB substrate where a coil winding bonding material coating area is located is cylindrically molded and formed on the lower end thereof, and wherein both ends of the coil are connected to one end of each electrode pattern, the first and second lead wires are connected to the other end of each electrode pattern, and the incision portion is a single incision formed in the yoke is formed opposing the connection portion between the lead wires and the electrode pattern.

3. The electro-acoustic micro-transducer according to claim 1, wherein the bobbin is rectangularly formed, where first and second band type electrode patterns are lengthily separated and formed on the upper end of the bobbin and a flexible PCB substrate where a coil winding bonding material coating area is located is cylindrically molded and formed on the lower end thereof, and both ends of the coil are connected to one end of each electrode pattern, the first and second lead wires are connected to an opposing position of each electrode pattern with respect to the center of the bobbin, and the incision portion is a pair of incision portions formed in the yoke are formed opposing the first and second connection portions between the lead wires and the electrode pattern.

4. The electro-acoustic micro-transducer according to claim 3, wherein the frame further comprises: first and second guiders for molding the first and second lead wires withdrawn from the coil externally via each of the throughhole in zigzag form; and an electrode terminal plate in which the first and second lead wires withdrawn via each guider are connected to the lower surface of the frame in either side of the throughhole and first and second electrode pads via which drive signals are applied externally are separately formed, wherein the first and second guiders are removed at the state where the other ends of the first and second lead wires are fixed to the first and second electrode pads.

5. The electro-acoustic micro-transducer according to claim 2, wherein the frame further comprises: an electrode terminal plate in which the lead wire withdrawn from the coil is connected to the lower surface of the frame connected to the throughhole and first and second electrode pads via which drive signals are applied externally are separately formed.

6. The electro-acoustic micro-transducer according to claim 1, wherein the vibration diaphragm comprises:

a body extended from a neck portion on which the bobbin is attached to an outer end in cone shape;

a dust cap of a dome shape formed in the neck portion;

a rib continuously protruded at a predetermined width and height from the center of the dust cap to the outer end of the body; and an edge for supporting the body to the frame, wherein the body, the dust cap, the rib and the edge are integrally formed.

7. The electro-acoustic micro-transducer according to claim 1, wherein the vibration diaphragm and further comprises a reinforcing body attached to the lower end of the vibration diaphragm, having a hole corresponding to the center portion of the dust cap, for reducing a non-linear distortion of the vibration diaphragm.

8. The electro-acoustic micro-transducer according to claim 3, wherein the flexible PCB substrate further comprises third and fourth band type electrode patterns electrically connected with the first and second band type electrode patterns in the inner side surface, for compensating for a linearity of DC magnetic field generated from the permanent magnet.

9. The electro-acoustic micro-transducer according to claim 1, further comprising: a plurality of sound output holes and a cover plate combined in the lower end of the frame, for preventing foreign matter from entering the frame.

10. An electro-acoustic micro-transducer comprising:

a yoke formed of an internal circular groove and first and second vertical incision portions for removing a predetermined vertical wall at each side surface;

a permanent magnet installed in the groove of the yoke, for generating a non-alternating magnetic field;

a plate mounted on the upper surface of the permanent magnet, for forming a magnetic gap between the outer circumferential surface and the upper end of the yoke;

a coil wound on a bobbin, which generates an alternating magnetic field when a drive signal is applied and is disposed in the magnetic gap to be displaced up and down according to an interaction with a non-alternating magnetic field generated from the permanent magnet;

a cylindrical frame in which the outer circumferential portion surrounds the yoke at the state where the yoke is set to be positioned in the center, the outer circumferential portion is perpendicularly extensively formed in such a manner that a groove is formed therein and first and second externally communicating throughholes are formed in the first and second groove spaces opposing the incision portion of the yoke; and a vibration diaphragm in which the bobbin is supported and the outer circumferential portion is supported in the upper end of the frame, for generating an acoustic sound in correspondence to the drive signal when the bobbin is displaced up and down, wherein first and second groove spaces respectively formed by the first and second incision portions and the first and second groove spaces are formed of a magnitude of preventing first and second connection portions of the first and second flexible wires fixed to the bobbin from contacting the yoke and the frame during vertical vibration of the bobbin, in order to apply the drive signal externally, to thereby extend an up-and-down vibration width of the bobbin.

* * * * *